US005991930A

United States Patent [19]

Sorrentino

[11] Patent Number: 5,991,930

[45] Date of Patent: Nov. 30, 1999

[54] PROTECTIVE HELMET WITH ATTACHABLE VISOR

[76] Inventor: James J. Sorrentino, 23 Edgar Rd., Scituate, Mass. 02066

[21] Appl. No.: 09/074,153

[22] Filed: May 7, 1998

[51] Int. Cl.[6] ..... A42B 3/22

[52] U.S. Cl. ..... 2/424; 2/425

[58] Field of Search ..... 2/424, 422, 15, 2/10, 12, 425, 410, 411, 171.3

[56] References Cited

U.S. PATENT DOCUMENTS

| | | | |
|---|---|---|---|
| 5,333,328 | 8/1994 | Roberts | 2/422 |
| 5,365,615 | 11/1994 | Piszkin | 2/422 |
| 5,392,468 | 2/1995 | Leddick, III | 2/424 |
| 5,555,570 | 9/1996 | Bay, Jr. | 2/424 |
| 5,647,066 | 7/1997 | Joslin et al. | 2/424 |
| 5,651,145 | 7/1997 | Egger | 2/425 |
| 5,896,587 | 4/1999 | Gentry | 2/425 |

*Primary Examiner*—Michael A. Neas

[57] ABSTRACT

A new protective helmet with attachable visor for protecting a cyclists eyes without need of glasses. The inventive device includes a protective visor adapted for removable securement to a front peripheral edge of a protective helmet. The protective visor has a plurality of hook and loop strips disposed on an interior surface of an upper edge thereof. The hook and loop strips couple with corresponding hook and loop strips disposed on the protective helmet.

5 Claims, 2 Drawing Sheets

PROTECTIVE HELMET WITH ATTACHABLE VISOR

BACKGROUND OF THE INVENTION

1. Field of the Invention

The present invention relates to eyeshields and more particularly pertains to a new protective helmet with attachable visor for protecting a cyclists eyes without need of glasses.

2. Description of the Prior Art

The use of eyeshields is known in the prior art. More specifically, eyeshields heretofore devised and utilized are known to consist basically of familiar, expected and obvious structural configurations, notwithstanding the myriad of designs encompassed by the crowded prior art which have been developed for the fulfillment of countless objectives and requirements.

Known prior art eyeshields include U. S. Pat. No. Des. 361,868 to Raugh; U.S. Pat. No. 2,519,959 to Fisher; U.S. Pat. No. 4,524,465 to Huber; U.S. Pat. No. 3,984,875 to Farquharson; U.S. Pat. No. 4,001,894 to Roques-Rogery; and U.S. Pat. No. 3,039,108 to Lohrenz.

While these devices fulfill their respective, particular objectives and requirements, the aforementioned patents do not disclose a new protective helmet with attachable visor. The inventive device includes a protective visor adapted for removable securement to a front peripheral edge of a protective helmet. The protective visor has a plurality of hook and loop strips disposed on an interior surface of an upper edge thereof. The hook and loop strips couple with corresponding hook and loop strips disposed on the protective helmet.

In these respects, the protective helmet with attachable visor according to the present invention substantially departs from the conventional concepts and designs of the prior art, and in so doing provides an apparatus primarily developed for the purpose of protecting a cyclists eyes without need of glasses.

SUMMARY OF THE INVENTION

In view of the foregoing disadvantages inherent in the known types of eyeshields now present in the prior art, the present invention provides a new protective helmet with attachable visor construction wherein the same can be utilized for protecting a cyclists eyes without need of glasses.

The general purpose of the present invention, which will be described subsequently in greater detail, is to provide a new protective helmet with attachable visor apparatus and method which has many of the advantages of the eyeshields mentioned heretofore and many novel features that result in a new protective helmet with attachable visor which is not anticipated, rendered obvious, suggested, or even implied by any of the prior art eyeshields, either alone or in any combination thereof.

To attain this, the present invention generally comprises a helmet portion adapted for being worn on a head of a wearer. The helmet portion has a pair of vent holes through a front portion thereof. The helmet portion has a plurality of hook and loop strips secured to a front peripheral edge thereof. A protective visor is adapted for removable securement to the front peripheral edge of the helmet portion. The protective visor has a plurality of hook and loop strips disposed on an interior surface of an upper edge thereof. The hook and loop strips couple with the hook and loop strips of the helmet portion. The protective visor has a pair of angularly disposed air vents therethrough inwardly of opposing side edges thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective helmet with attachable visor apparatus and method which has many of the advantages of the eyeshields mentioned heretofore and many novel features that result in a new protective helmet with attachable visor which is not anticipated, rendered obvious, suggested, or even implied by any of the prior art eyeshields, either alone or in any combination thereof.

It is another object of the present invention to provide a new protective helmet with attachable visor which may be easily and efficiently manufactured and marketed.

It is a further object of the present invention to provide a new protective helmet with attachable visor which is of a durable and reliable construction.

An even further object of the present invention is to provide a new protective helmet with attachable visor which is susceptible of a low cost of manufacture with regard to both materials and labor, and which accordingly is then susceptible of low prices of sale to the consuming public, thereby making such protective helmet with attachable visor economically available to the buying public.

Still yet another object of the present invention is to provide a new protective helmet with attachable visor which provides in the apparatuses and methods of the prior art some of the advantages thereof, while simultaneously overcoming some of the disadvantages normally associated therewith.

Still another object of the present invention is to provide a new protective helmet with attachable visor for protecting a cyclists eyes without need of glasses.

Yet another object of the present invention is to provide a new protective helmet with attachable visor which includes a protective visor adapted for removable securement to a front peripheral edge of a protective helmet. The protective visor has a plurality of hook and loop strips disposed on an interior surface of an upper edge thereof. The hook and loop strips couple with corresponding hook and loop strips disposed on the protective helmet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
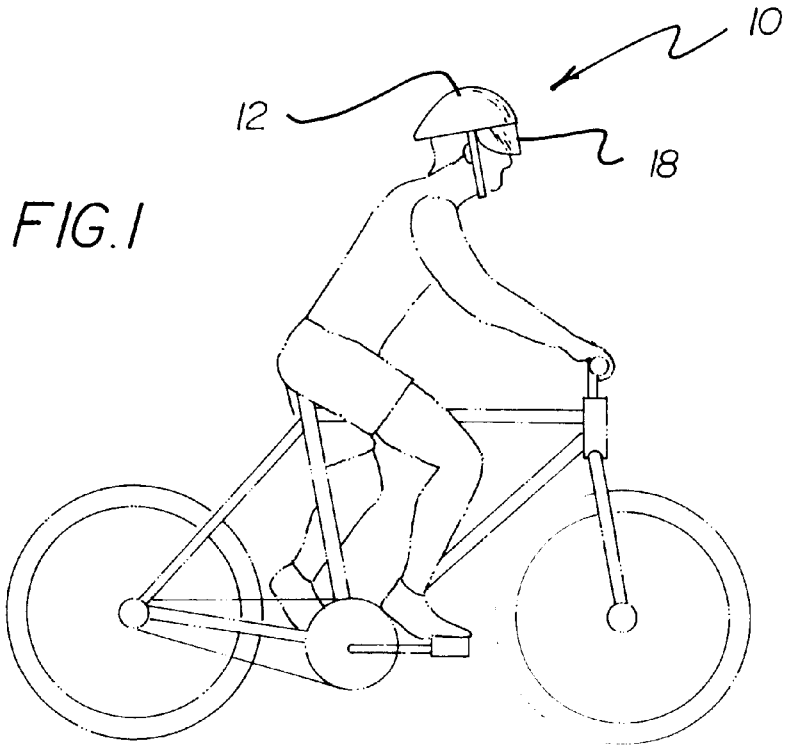
FIG. 1 is a side view of a new protective helmet with attachable visor according to the present invention.
Figure 2:
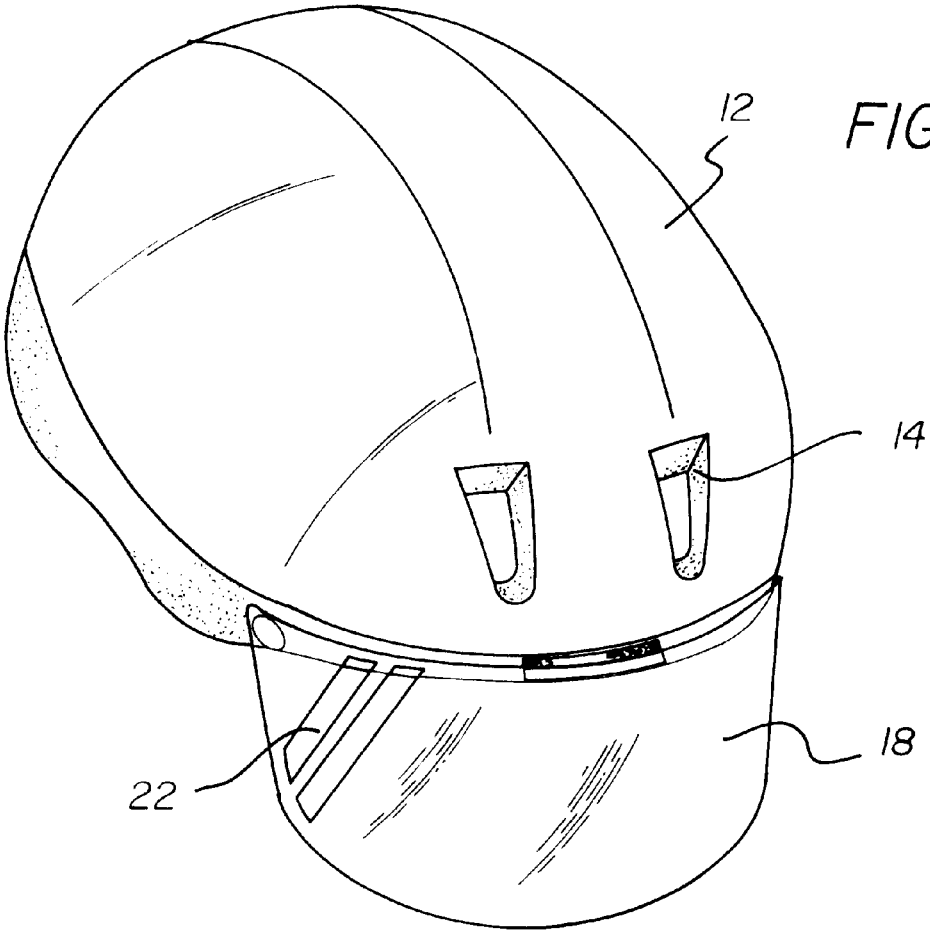
FIG. 2 is a perspective view of the present invention.
Figure 3:
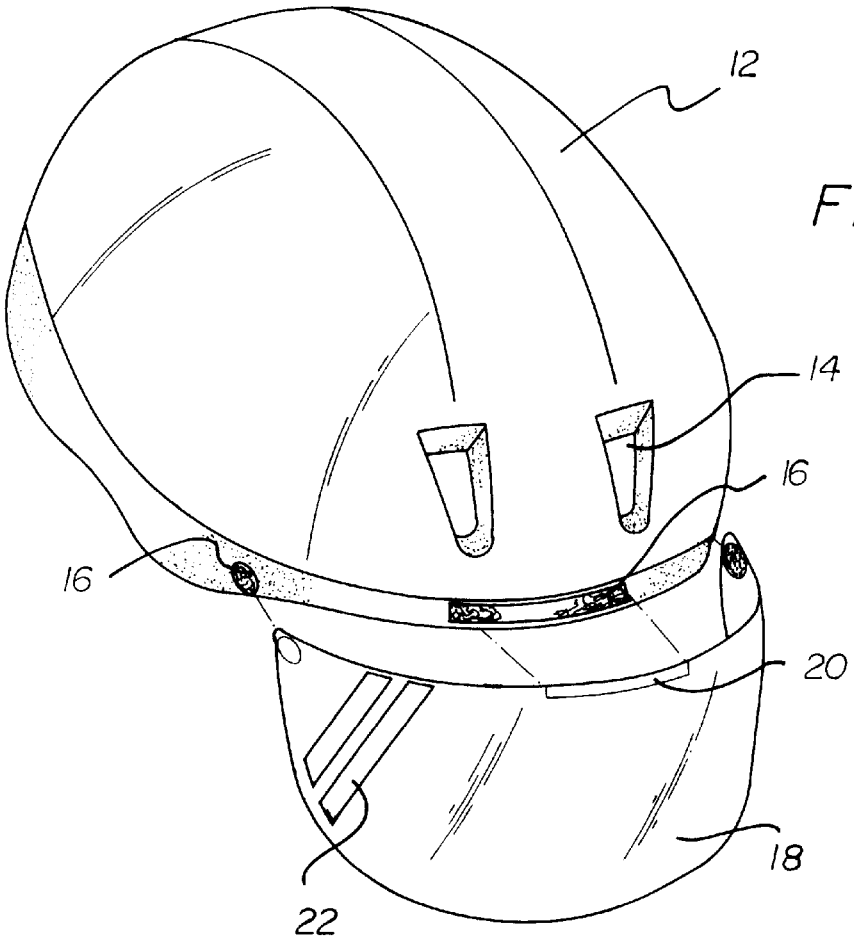
FIG. 3 is a perspective view of the present invention illustrated with the protective visor removed from the helmet portion.
Figure 4:
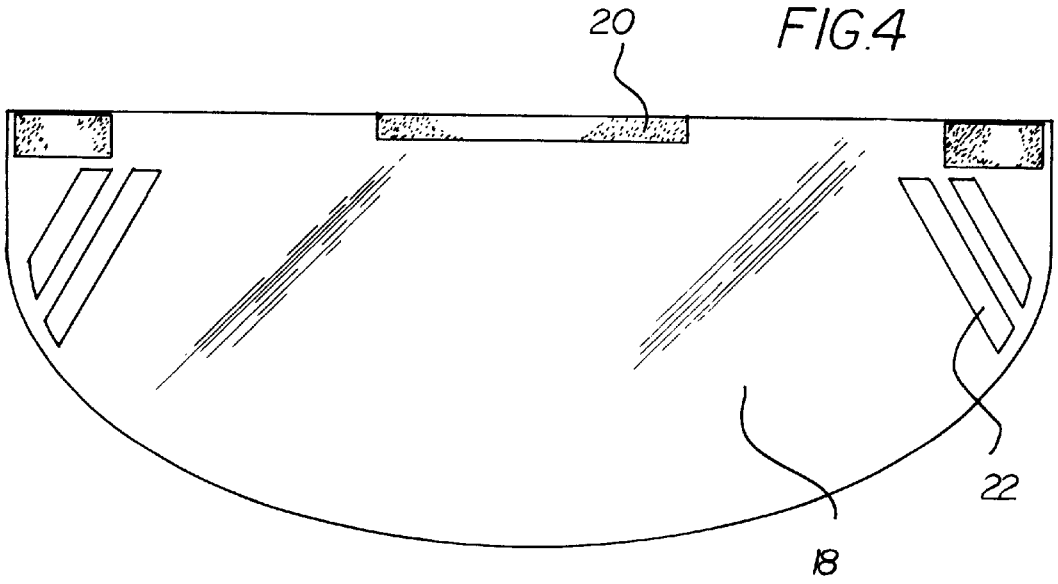
FIG. 4 is a rear view of the protective visor of the present invention.

With reference now to the drawings, and in particular to FIGS. 1 through 4 thereof, a new protective helmet with attachable visor embodying the principles and concepts of the present invention and generally designated by the reference numeral 10 will be described.

As best illustrated in FIGS. 1 through 4, the protective helmet with attachable visor 10 comprises a helmet portion 12 adapted for being worn on a head of a wearer. The helmet portion 12 has a pair of vent holes 14 through a front portion thereof. The helmet portion 12 has a plurality of hook and loop strips 16 secured to a front peripheral edge thereof.

A protective visor 18 is adapted for removable securement to the front peripheral edge of the helmet portion 12. The protective visor 18 has a plurality of hook and loop strips 20 disposed on an interior surface of an upper edge thereof. The hook and loop strips 20 couple with the hook and loop strips 16 of the helmet portion 12. The protective visor 18 has a pair of angularly disposed air vents 22 therethrough inwardly of opposing side edges thereof. The protective visor 18 would cover the top half of the user's face. The visor 18 would measure approximately twelve inches wide by three inches high and would be curved to fit around the face. The air vents 22 would allow air to circulate through the visor. The protective visor 18 is preferably constructed of plastic. The plastic could be clear or tinted various shades.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective helmet with attachable visor for protecting a cyclists eyes without need of glasses comprising, in combination:

a helmet portion adapted for being worn on a head of a wearer, the helmet portion having a pair of vent holes through a front portion thereof, the helmet portion having a plurality of hook and loop strips secured to a front peripheral edge thereof;

a protective visor adapted for removable securement to the front peripheral edge of the helmet portion, the protective visor having a plurality of hook and loop strips disposed on an interior surface of an upper edge thereof, the hook and loop strips coupling with the hook and loop strips of the helmet portion, the protective visor having two pairs of angularly disposed air vents therethrough positioned inwardly of opposing side edges thereof;

the length of the visor along an upper edge thereof being about 12 inches;

the width of the visor between the upper edge and a lowermost portion being about 3 inches for only covering about a top half of a user's face;

each of the air vents of the visor having a pair of ends and a pair of parallel sides extending between the ends, the parallel sides of each air vent of a pair of air vents being substantially parallel each other, the ends of each of the air vents being generally parallel an adjacent portion of an outer periphery of the protective visor;

the parallel sides of the air vents of each pair of air vents angling downwardly from an upper edge of the visor towards lower corners of the visor; and each of the vent holes of the helmet portion having an arcuate front end, a generally rectangular back end, and a pair of lateral sides extending between the ends, the lateral sides tapering apart from the front end towards the back end.

2. A protective helmet with attachable visor for protecting a cyclists eyes without need of glasses comprising:

a helmet portion adapted for being worn on a head of a wearer, the helmet portion having a pair of vent holes through a front portion thereof, the helmet portion having a plurality of hook and loop strips secured to a front peripheral edge thereof, each of the vent holes of the helmet portion having an arcuate front end, a generally rectangular back end, and a pair of lateral sides extending between the ends, the lateral sides tapering apart from the front end towards the back end; and a protective visor adapted for removable securement to a front peripheral edge of a protective helmet, the protective visor having a plurality of hook and loop strips disposed on an interior surface of an upper edge thereof, the hook and loop strips coupling with corresponding hook and loop strips disposed on the protective helmet.

3. A protective helmet with attachable visor for protecting a cyclists eyes without need of glasses comprising:

a protective visor adapted for removable securement to a front peripheral edge of a protective helmet, the protective visor having a plurality of hook and loop strips disposed on an interior surface of an upper edge thereof, the hook and loop strips coupling with corresponding hook and loop strips disposed on the protective helmet the protective visor having two pairs of angularly disposed air vents therethrough inwardly of opposing side edges thereof;

each of the air vents of the visor having a pair of ends and a pair of parallel sides extending between the ends, the parallel sides of each air vent of a pair of air vents being substantially parallel to each other, the ends of each of the air vents being generally parallel an adjacent portion of an outer periphery of the protective visor; and the parallel sides of the air vents of each pair of air vents angling downwardly from an upper edge of the visor towards lower corners of the visor;

wherein the helmet portion has a pair of vent holes through a front portion thereof; and wherein each of the vent holes of the helmet portion have an arcuate front end, a generally rectangular back end, and a pair of lateral sides extending between the ends, the lateral sides tapering apart from the front end towards the back end.

4. The protective helmet with attachable visor as set forth in claim 3 wherein the length of the visor along an upper edge thereof is about 12 inches.

5. The protective helmet with attachable visor as set forth in claim 3 wherein the width of the visor between the upper edge and a lowermost portion being about 3 inches for only covering about a top half of a user's face.

* * * * *